United States Patent [19]

Thilo et al.

[11] 4,162,489

[45] Jul. 24, 1979

[54] FIRE ALARM SYSTEM COMPRISING A PLURALITY OF ALARMS WHICH MAY BE OPERATED BY WAY OF AN ALARM LOOP

[75] Inventors: Peer Thilo; Otto W. Moser, both of Munich, Fed. Rep. of Germany

[73] Assignee: Siemens Aktiengesellschaft, Berlin & Munich, Fed. Rep. of Germany

[21] Appl. No.: 821,837

[22] Filed: Aug. 4, 1977

[30] Foreign Application Priority Data

Aug. 24, 1976 [DE] Fed. Rep. of Germany ..... 2638068

[51] Int. Cl.[2] ..... G08B 17/00

[52] U.S. Cl. ..... 340/518; 340/584; 340/628

[58] Field of Search ..... 340/408, 227 R, 237 S, 340/505, 518, 584, 628

[56] References Cited

U.S. PATENT DOCUMENTS

| | | | |
|---|---|---|---|
| 3,214,734 | 10/1965 | Whitehead | 340/408 |
| 3,482,243 | 12/1969 | Buchsbaum | 340/408 |
| 3,676,877 | 7/1972 | Kobayashi | 340/227 R |
| 3,733,596 | 5/1973 | Prima | 340/518 |
| 3,753,258 | 8/1973 | Honda | 340/408 |
| 3,797,008 | 3/1974 | Yuasa | 340/227 R |
| 3,832,678 | 8/1974 | Gysell et al. | 340/227 R |
| 3,932,858 | 1/1976 | Smith et al. | 340/408 |

*Primary Examiner*—Glen R. Swann, III

*Attorney, Agent, or Firm*—Hill, Van Santen, Steadman, Chiara & Simpson

[57] ABSTRACT

A fire alarm system comprises a plurality of alarms which may be operated via an alarm loop and which, being subject to selective interrogation, each alarm transmits an analog value of a particular characteristic of a fire to a central control, the analog value being tapped from a detector for that characteristic. Each alarm comprises an alarm circuit which has a load resistor which can be connected in parallel to the alarm loop by means of a timing element and which amplifies the current which characterizes the alarm at the instant of interrogation.

7 Claims, 10 Drawing Figures

00
01
02
100msec
300msec
10sec

Ze
N
N02
N01
N00
Sy
st
Us
Re1
Re2
Wi1
Wi2
Wi3
Ke
Ue
Ba1
Ba2
INVERTER
D.C.
+

FIRE ALARM SYSTEM COMPRISING A PLURALITY OF ALARMS WHICH MAY BE OPERATED BY WAY OF AN ALARM LOOP

CROSS REFERENCE TO RELATED APPLICATIONS

This application is related to an application of Otto Walter Moser et al, Ser. No. 821 839 filed Aug. 4, 1977 and is also related to an application of Peer Thilo et al, Ser. No. 821,840 filed Aug. 4, 1977.

BACKGROUND OF THE INVENTION

1. Field of the Invention

This invention relates to a fire alarm system, and more particularly to such a system which comprises a plurality of alarms which may be operated by an alarm loop, and which are subject to selective interrogation so as to feed an analog value of a particular fire characteristic to a central control, the analog value being tapped from a measuring transducer for that particular characteristic.

2. Description of the Prior Art

Fire alarm system are well known in the art and may be supplied by a commercial power supply or by batteries. In the event of a breakdown of the commercial supply, fire alarm systems are to be supplied for a minimum length of time by a second, independent energy source. Batteries generally serve this purpose. The requisite capacity of this emergency current supply is determined, on the one hand, by the current drain of the alarm central control, and, on the other hand, by the number of alarms connected to the central control.

SUMMARY OF THE INVENTION

The object of the present invention is to considerably reduce the energy consumption in the individual alarms, without thereby endangering the alarm transmission from the alarms to the central control and to provide that the system will operate without disturbances notwithstanding the lower energy consumption.

According to the invention, the above objects are achieved in a fire alarm system of the type mentioned above in that each alarm has a load resistor which can be connected in parallel to the alarm loop by means of a timing element, and which in each case amplifies the current characterized by the alarm at the instant of interrogation. Advantageously, the load resistor can be the resistor of an RC element which constitutes the timing element. It is also advantageous for the load resistor to form part of a monostable trigger stage.

In a further development of the invention, the selective interrogation of the individual alarms, that is a request for the alarms to emit their fire characteristic analog values which can be tapped from respective measuring transducers, can be effected by means of chain synchronization, i.e. by a common disconnection of all of the alarms from the alarm loop prior to interrogation and a subsequent reconnection of the alarms to the alarm loop, the reconnection being made by reconnecting the alarms consecutively one after the other.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENT

Figure 1:
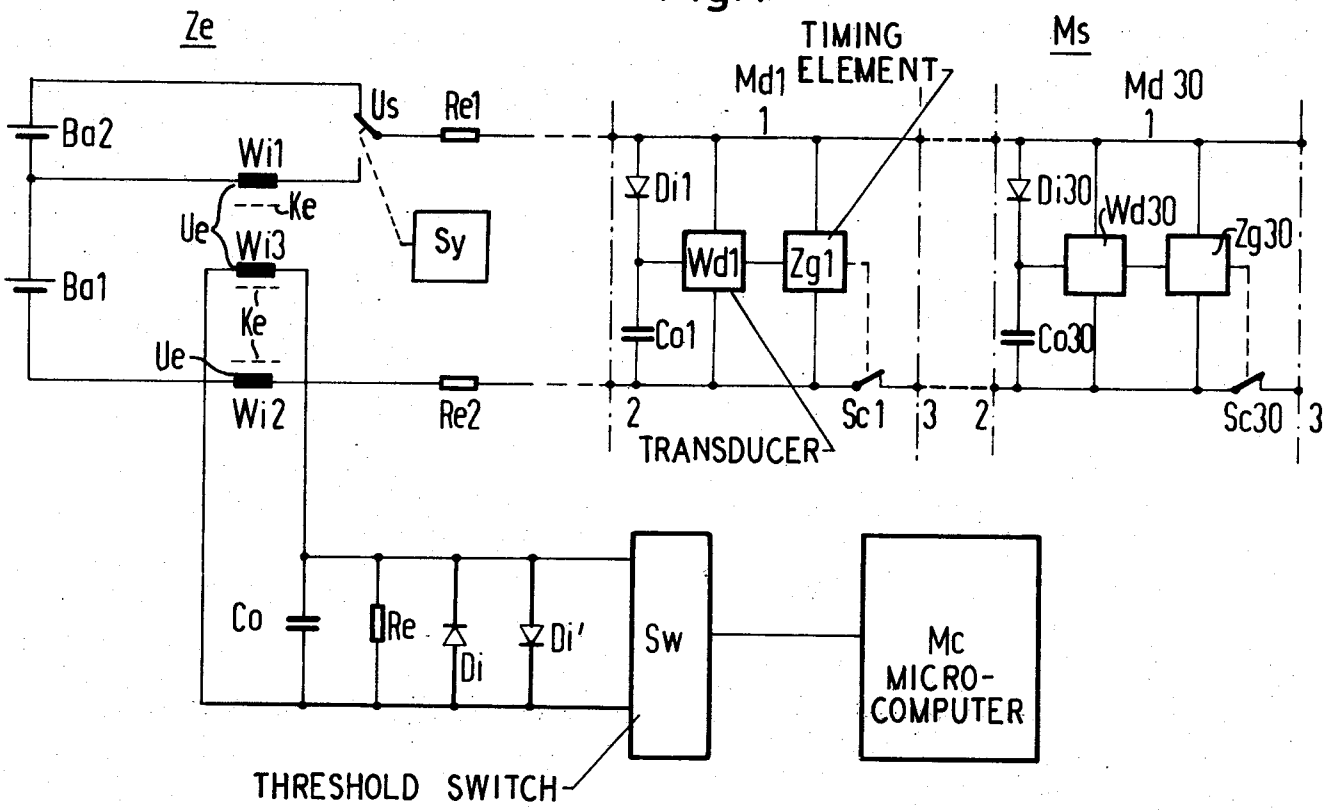
FIG. 1 is a schematic illustration of a fire alarm system comprising a plurality of alarm circuits which are connectible in an alarm loop.
Figure 2:
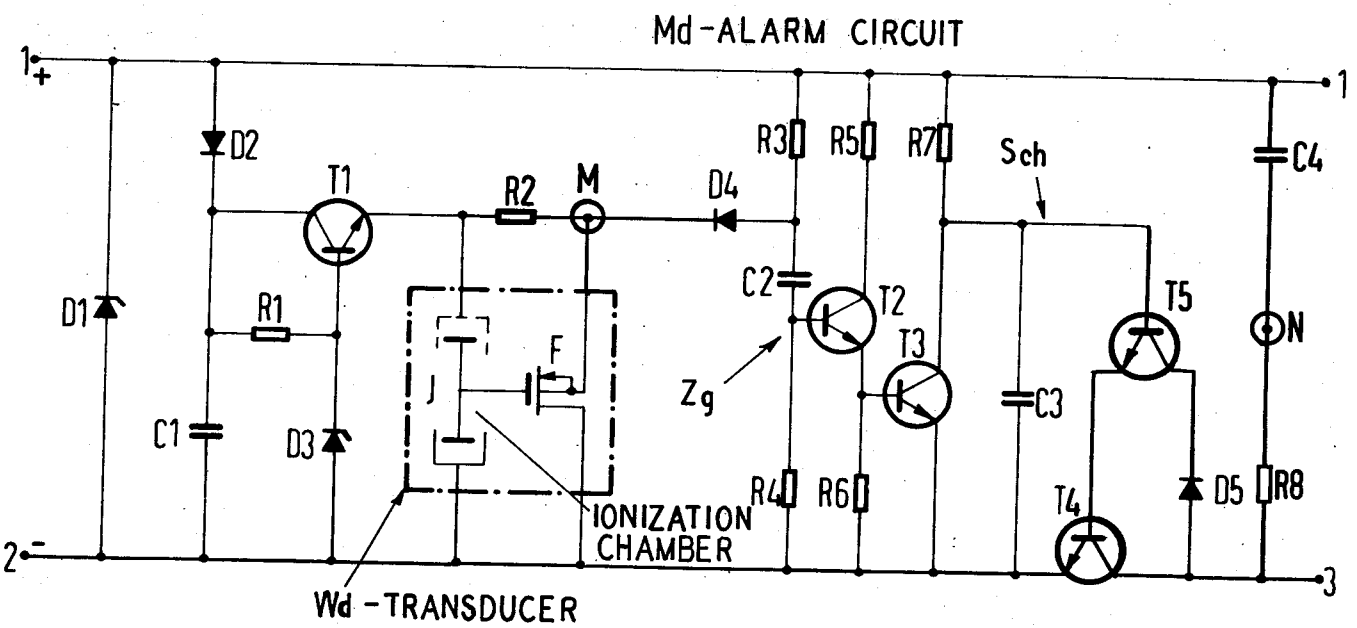
FIG. 2 is a schematic circuit diagram of an individual alarm circuit.
Figure 8:
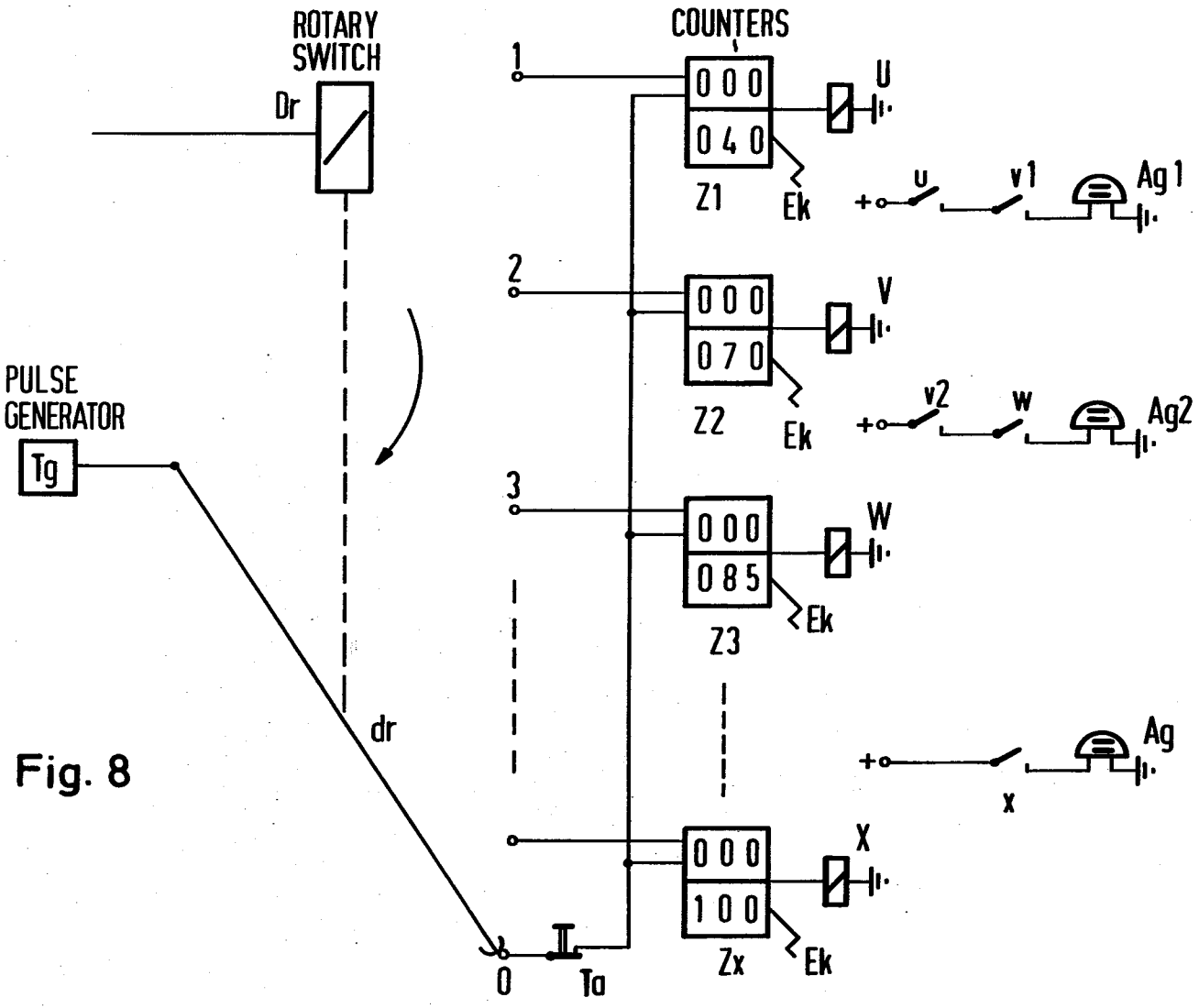
FIG. 8 is a schematic circuit representation illustrating the function of the micro-computer of FIG. 1.
Figure 9:
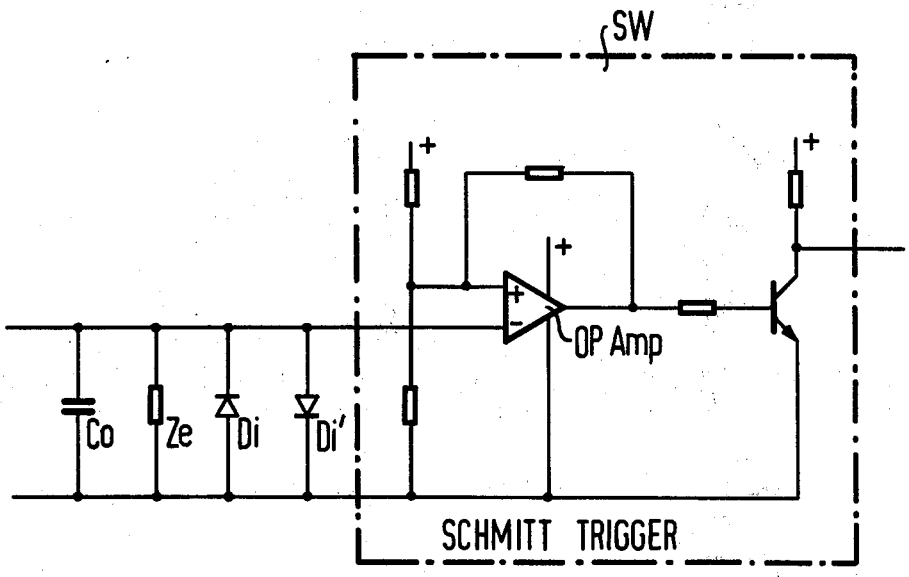
FIG. 9 is a schematic circuit diagram of a Schmitt trigger circuit which may be employed for the threshold switch of FIG. 1.

In the fire alarm system illustrated in FIG. 1, a plurality of alarm circuits Md1–Md30 and an analysis device Mc have been illustrated in a schematic form, detailed illustrations being available in FIGS. 2 and 8. The system comprises a central control Ze and an alarm loop Ms formed by the alarm circuits. The alarm loop Ms is connected, in the central control Ze to a pair of serially connected batteries Ba1 and Ba2 by way of a transfer switch Us. A pair of interrogation windings Wi1 and Wi2 are symmetrically looped into the supply lines of the battery Ba1, and feed pulses occurring in the supply lines, by way of a common core Ke, to an output winding Wi3. The windings Wi1–Wi3 on the common core Ke is tuned by a capacitor Co to a particular resonant frequency, and it is also strongly attenuated by a resistor Re. The interrogation signals emitted from the alarm circuits by way of the transformer pass two limiting diodes Di, Di' connected in opposite polarity fashion to each other and are received by a threshold value switch Sw, the diodes and the switch forming rectangular pulses which are then fed to a micro-computer Mc. In the micro-computer the rectangular pulses are individually analyzed, as will be described below in connection with FIG. 8, to determine if the signals represent a fire characteristic which should be considered an alarm condition.

Figure 3:
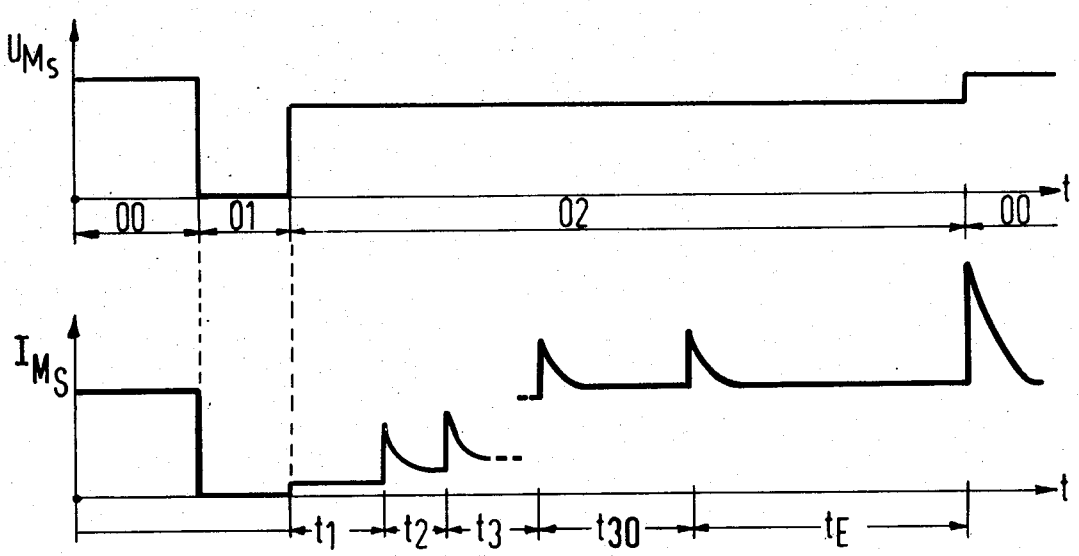
FIG. 3 is an interrogation diagram illustrating an interrogation command (voltage curve) and the resulting interrogation answer (current curve)

In a state of readiness for operation, the alarm loop Ms is connnected to the higher voltage of the batteries Ba1 and Ba2, as illustrated in FIG. 1 and as shown on the voltage curve of FIG. 3 in the range 00. For an interrogation, the transfer switch Us must first be opened so that a voltage gap is formed, as indicated by the range 01 in FIG. 3. Then the transfer switch must be closed to the operating position, that is to the lower contact illustrated in FIG. 1 so as to connect the lower voltage of the battery Ba1 to the loop and initiate the interrogation range 02 in FIG. 3. As a result, voltage again is applied to a pair of attenuating resistors Re1 and Re2 of the alarm loop Ms. Finally, the transfer switch must be returned to its rest position, and thus to the higher voltage of the two batteries Ba1 and Ba2 in series to again reach a rest state 00.

As a result of the disconnection of the voltage from the measuring loop Ms, the timing elements Zg1–Zg30 in the respective alarm circuits open the respective interrogation switches, schematically illustrated as switches Sc1–Sc30 in the individual alarm circuits so that all of the alarm circuits are disconnected from the central control Ze in the range 01. If voltage is again applied to the alarm circuit Md1, the detector, in the form of a measuring transducer Wd1 is powered to control the timing element Zg1 in accordance with the fire characteristic value, which timing element closes the interrogation switch Sc1 after a predetermined length of time, and thus connects the alarm circuit Md2 to the central control Ze. In this manner, all of the alarm circuits Md1–Md30 are sequentially connected to the central control Ze in the form of a chain, for different lengths of time. Here, the individual alarm circuits Md1–Md30 are characterized by the sequence of their reconnection to the central control Ze and the fire characteristic values are characterized by the time differences $t_1$–$t_{30}$ between the activation of the individual alarm circuits. The function of the series connection of a diode Di1–Di30 and the associated capacitors Co1–Co30 in the individual alarm circuits is simply to supply the transducers and possibly also the timing elements with voltage for the time at which the voltage is disconnected from the central control Ze.

FIG. 2 illustrates in detail an alarm circuit Md. A Zener diode D1 serves only as a protection against excess voltages, and when the alarm circuit Md is connected to an incorrect polarity the Zener diode protects the individual components, in particular the transistors T1, etc. A diode D2 allows a capacitor C1 to charge for such time as the high voltage of the two batteries Ba1 and Ba2 is connected to the alarm loop Ms in the range 00. On the other hand, it prevents the capacitor C1 from discharging when the alarm loop Ms is disconnected from the central control Ze in the range 01, or is supplied by the battery Ba1 in the range 02. However, the capacitor C1 itself supplies the requisite operating voltage for the alarm Md, and thus bridges the voltage gaps, that is the range 01. A transistor T1, in association with a resistor R1 and a Zener diode D3, serves to stabilize the voltage for an ionization chamber J. A field effect transistor F, in combination with a load resistor R2, amplifies the output voltage of the ionization chamber J. Thus, the voltage across a measuring point M changes in dependence upon the particular characteristic of a fire, here the smoke concentration in the ionization chamber J.

In FIG. 2, the timing element Zg which has been illustrated in FIG. 1 comprises a plurality of resistors R3–R6, a capacitor C2 and a pair of transistors T2 and T3. The transistors T2 and T3 are conductive for such time as the capacitor C2 is charged. Following the disconnection of the voltage from the central control Ze, the capacitor C2 had been discharged, and a diode D4 blocked the voltage at the measuring point M. After reconnection of the alarm circuit to the voltage of the battery Ba1, the capacitor C2 is recharged to the voltage prevailing at the measuring point M. During this period of time, a pair of interrogation transistors T4 and T5 are in a blocking condition. When the voltage across the capacitor C2 has reached the value predetermined by the measuring point M, the transistors T2 and T3 block and render the transistors T4 and T5 conductive, by which action these transistors connect the next alarm circuit, in this example the alarm circuit Md2, to the alarm loop Ms. A resistor R7 determines the base current for the transistor T5. A capacitor C3 prevents the transistor T4 from being temporarily switched through, as a result of transients, when the voltage is connected across the terminals 1 and 2. Finally, a diode D5 serves only to assist the drive of the transistor T4, but does not form a part of the present invention and is a primary feature of the aforementioned Moser et al application. When the next alarm circuit is connected to the alarm loop Ms, the series arrangement of a resistor R8 and a capacitor C4 is also connected to the alarm loop Ms, so that the latter is recharged; on the occasion of the last voltage disconnection it had discharged by way of the alarm loop Ms.

The charging current of the capacitor C4 produces switch-on current peaks as illustrated in the current curve $I_M$ of FIG. 3 at the end of the times $t_1$, $t_2$, etc. respectively for each alarm circuit, and thus clearly characterizes the switching on of the particular next alarm circuit.

Figure 4:
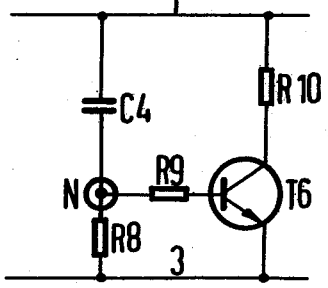
FIG. 4 is a schematic circuit diagram of a monostable trigger stage having a load resistor which may be employed in practicing the present invention.

In FIG. 4, a transistor T6 is connected by way of a resistor R9 to a connection point N of the capacitor C4 and the resistor R8 discussed above with respect to FIG. 2. Here, a collector resistor R10 produces a current amplification in the measuring loom Ms.

Figure 5:
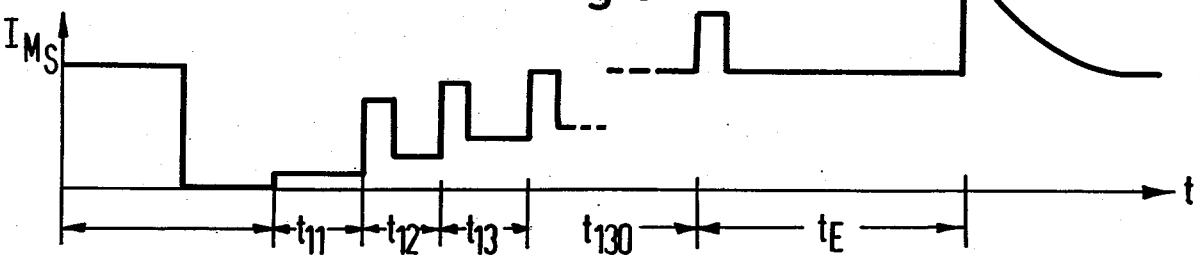
FIG. 5 illustrates a current curve associated with the circuit of FIG. 4.

FIG. 5 illustrates the current curve produced on the alarm loop Ms by the monostable trigger circuit of FIG. 4, for the respective intervals $t_{11}$, $t_{12}$, etc and out to the end of a time interval $t_E$ at which, in comparing back to FIG. 3, the system is placed back in the range OO.

Figures 6, 6A:
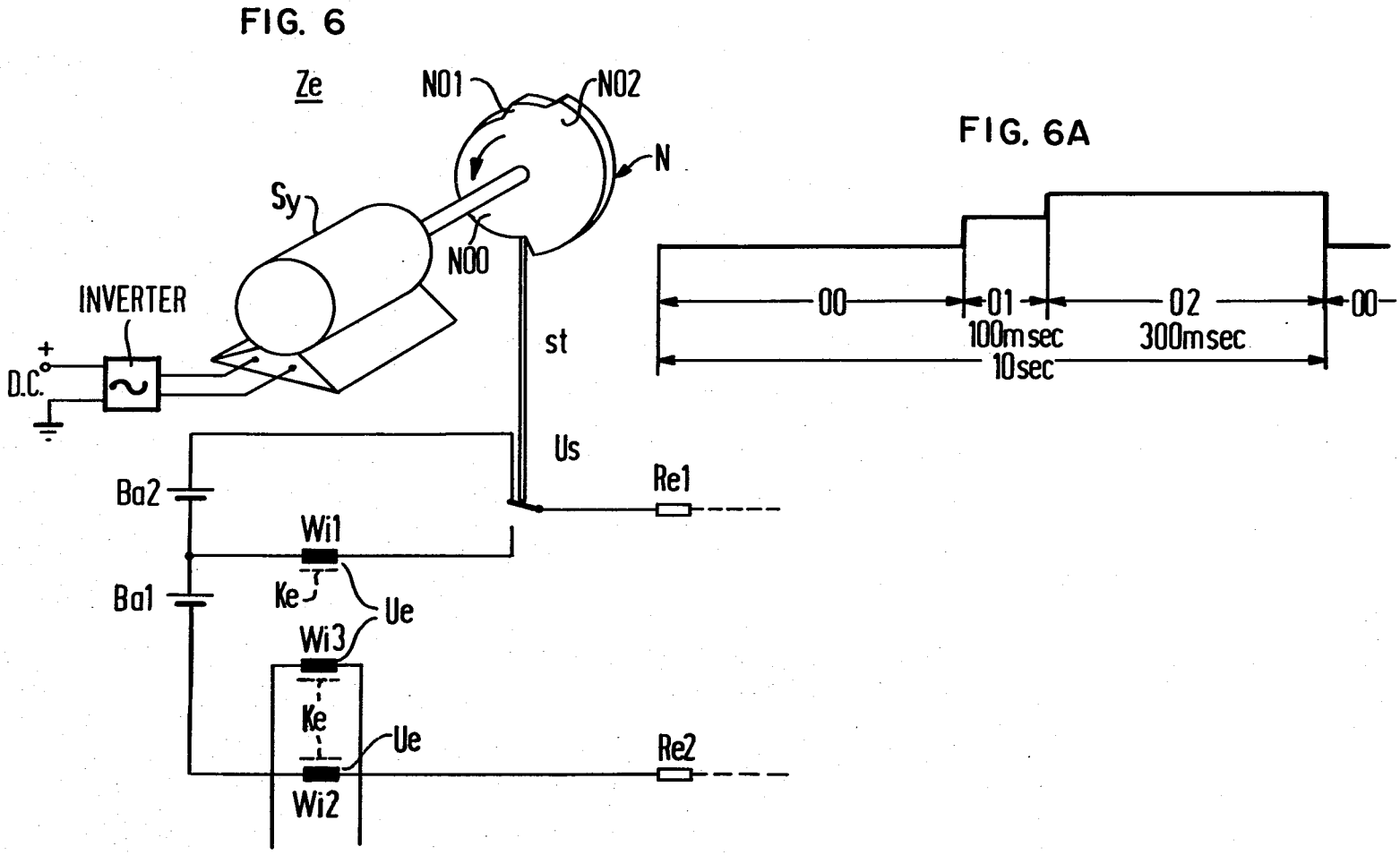
FIG. 6 is a schematic circuit diagram of apparatus for applying power to the alarm loop.
FIG. 6A is a camming diagram as an aid to understanding the operation of the circuit of FIG. 6.

Referring now to FIGS. 6–9, apparatus for establishing the ranges 00, 01 and 02, and the apparatus for reading and analyzing the resulting signals will be discussed in greater detail. In FIG. 6, the transfer switch Us is illustrated as being mechanically linked by a push rod St to a cam N which is driven by a synchronous motor Sy. The cam N is illustrated as having three portions N00, N01 and N02, the portion N01 being a lobe slightly raised from the portion N00, and the portion N02 being raised from the portion N00 a greater amount. As the cam is rotated by the synchronous motor, in the direction illustrated by the arrow and from the position illustrated in FIG. 6, the rod St rides along the periphery of the portion N00 and permits the movable contact of the transfer switch Us to remain closed to its upper stationary contact. As the rod St engages the lobe N01, it is depressed to open that circuit for an interval of time, for example 100 msec, until the rod is engaged by the lobe N02, whereupon the movable contact is pushed into engagement with the lower stationary contact of the switch Us. The lobe N02 is dimensioned to provide an interrogation interval of, for example, 300 msec, as indicated on the camming diagram portion of FIG. 6. The action of one revolution of the cam N therefore provides a voltage curve illustrated in FIG. 3 for the ranges 00, 01 and 02.

Figure 7:
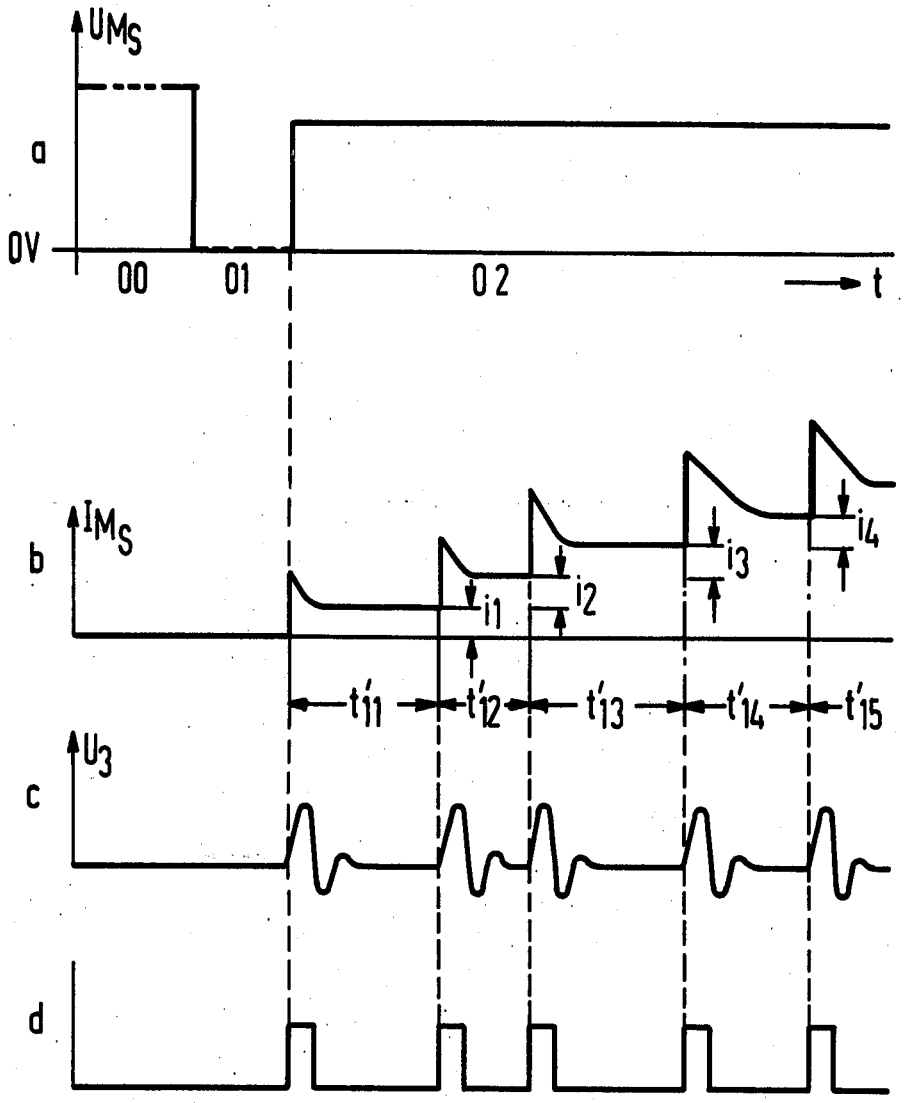
FIG. 7 is an interrogation diagram similar to that of FIG. 3, but showing in greater detail the signaling from the alarm circuits and the response to such signals in the central control.

Referring to FIG. 7, the interrogation and signaling of FIG. 3 is illustrated in greater detail wherein in the curve a, the voltage $U_{Ms}$ over the ranges 00, 01 and 02 is illustrated once more as is the resulting signaling current $I_M$ in a curve b. In the curve b, the height of the individual current steps $i_1$, $i_2$ etc is constant as the current rise per signal from an alarm station is almost independent from its measuring value. The length of the individual steps $t_{11}'$, $t_{12}'$ etc is respectively a measure for the measuring value of the appertaining current signal from the alarm circuits. The index line was selected in order to indicate that the values $t_{11}'$ etc are not directly related to the preceding intervals. As the signals from the alarm circuits are connected in the sequence of their arrangement along the loop Ms, each signal can be identified by including the current steps, as will be readily apparent to those skilled in the art from FIGS. 7 and 8.

As the primary windings $Wi_1$ and $Wi_2$ of the transformer Ue are symmetrically arranged in the loop, each current alteration effects a voltage pulse in the primary windings which is induced in the secondary winding Wi3. At the secondary winding, the transformer is tuned to a particular resonant frequency by a capacitor Co; and it is, moreover, strongly damped by the resistor Re. The output signal illustrated in curve c of FIG. 7 is fed to a threshold value switch Sw by way of the two limiter diodes Di and Di'. A representative circuit for the threshold value switch is the Schmitt trigger circuit illustrated in FIG. 9, which can be constructed in accordance with the teachings of Phil Schrrod in his article "Comparator Circuit Makes Versatile Schmitt Trigger", published in the Feb. 19, 1976 issue of the periodical "Electronics" at Page 128 et seq and the National Semiconductor Data Sheet on Operational Amplifiers, identified as LM741/LM741C. The threshold value switch and the limiting diodes convert the damped signals into voltage pulses as illustrated in the curve d in FIG. 7 and feeds the pulses to the micro-computer Mc which evaluates the pulse spacings.

A functional schematic circuit diagram of a microcomputer Mc is illustrated in FIG. 8 in a simplified form. The rectangular pulses are fed to an excitation winding Dr of a rotary switch having a movable contact arm dr. Pulsing of the winding Dr steps the selector contact arm dr from its home or zero position sequentially through its stationary contacts and back to the zero position. A pulse generator Tg provides pulses of, for example, 50 μus, to a plurality of counters Z1–Zx to measure the time spacing between two rectangular pulses of the curve d in FIG. 7. Each of the counters has an associated comparator which may be set to a predetermined pulse count by a dial Ek. When this pulse count is reached, an associated relay is operated, as will be apparent from the description below. Assuming that the counter Z1 has its associated comparator set to a value of 40 pulses, and that a pulse from the first alarm circuit Md1 is converted to the first pulse of the train in the curve d of FIG. 7 and causes the excitation winding Dr to move the selector contact arm dr to the contact 1, the pulse generator Tg feeds pulses to the counter Z1 until such time as the excitation winding Dr receives the next succeeding pulse from the curve d of FIG. 7. If and when 40 pulses are counted by the counter Z1, the comparator causes associated relay U to operate and close its contact u which prepares an alarm generator Ag1 for operation, an intervening contact v1 being opened. The second pulse received from the threshold switch Sw causes the pulses of the pulse generator Tg to be fed to the counter Z2 which, as illustrated in FIG. 8, is set to 70 pulses. Upon receipt of 70 pulses, the associated comparator causes a relay V to operate and close its contacts v1 and v2. Closure of the contact v1 causes the alarm generator Ag1 to operate, and closure of the contacts v2 prepares an alarm generator Ag2 for operation. The additional alarm generators Ag2–Ag3 can be connected with one another by way of corresponding contacts u–x of the relays U–X, and thus alarm signaling is safeguarded. The selector contact arm dr provides pulses to the reset input of the counters Z1–Zx when it has again reached its zero position. If the orderly functioning of the apparatus is to be examined, since no alarm was given for some time, a key Ta can be pushed and the resetting of the counters Zl–Zx can thus be delayed. An observer then recognizes whether the individual counters Zl–Zx reacted, or whether they remained in their zero position, and thus a defect of the apparatus can be determined.

The circuit illustrated in FIG. 8 serves only as a functional model. In order to provide the prescribed switching times, the electromechanical switching elements illustrated would be replaced by suitable electronic components.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A fire alarm system comprising: a plurality of alarm circuits which are connectible in an alarm loop for interrogation; and a central control connected to said alarm loop including means for applying operating power to said alarm circuits and means for receiving signals generated by said alarm circuits, each of said alarm circuits comprising:

a detector for detecting a predetermined characteristic of a fire and generating a representative first signal, signaling means connected to said detector and operated by said first signal to amplify and place the same as an amplified second signal on said loop, said signaling means including a timing circuit having a load resistance connected in parallel to said loop by said signaling means.

2. The alarm system of claim 1, wherein said timing circuit comprises:

a capacitor connected to said loop in series with said load resistor.

3. The alarm system of claim 2, comprising: means for discharging said capacitor prior to interrogation.

4. The alarm system of claim 2, comprising:

means for discharging said capacitor directly following interrogation.

5. The alarm system of claim 1, comprising:

a monostable circuit connected to said switching means, said load resistor also included in said monostable circuit.

6. The alarm system of claim 1, wherein:

said means for applying power to said alarm circuits includes first means for disconnecting power from said alarm circuits prior to interrogation, and second means for connecting power sequentially to said alarm circuits for interrogation.

7. The alarm system of claim 6, wherein:

said first means includes a power source and first switching means for connecting power to and disconnecting power from a first of said alarm circuits; and said second means includes second switching means in each of said signaling means for extending power to the next consecutive alarm circuit of the loop.

* * * * *